US011892251B2

(12) United States Patent
Qi et al.

(10) Patent No.: US 11,892,251 B2
(45) Date of Patent: Feb. 6, 2024

(54) HEAT EXCHANGER

(71) Applicant: HANGZHOU SANHUA RESEARCH INSTITUTE CO., LTD., Hangzhou (CN)

(72) Inventors: Zhaogang Qi, Hangzhou (CN); Linjie Huang, East Amherst, NY (US); Qiang Gao, Hangzhou (CN); Jianlong Jiang, Hangzhou (CN); Yujiao Niu, Hangzhou (CN); Chunyu Shao, Hangzhou (CN)

(73) Assignee: HANGZHOU SANHUA RESEARCH INSTITUTE CO., LTD., Hangzhou (CN)

( * ) Notice: Subject to any disclaimer, the term of this patent is extended or adjusted under 35 U.S.C. 154(b) by 280 days.

(21) Appl. No.: 17/329,142

(22) Filed: May 25, 2021

(65) Prior Publication Data

US 2021/0278148 A1 Sep. 9, 2021

Related U.S. Application Data

(63) Continuation of application No. PCT/CN2019/109050, filed on Sep. 29, 2019.

(30) Foreign Application Priority Data

Sep. 30, 2018 (CN) ..... 201811155651.2
Sep. 30, 2018 (CN) ..... 201811155652.7

(51) Int. Cl.
*F28F 9/02* (2006.01)
*F28F 1/12* (2006.01)

(52) U.S. Cl.
CPC ..... *F28F 9/0217* (2013.01); *F28F 9/0253* (2013.01); *F28F 9/0256* (2013.01); *F28F 1/126* (2013.01); *F28F 2275/12* (2013.01)

(58) Field of Classification Search
CPC .... F28D 9/0273; F28D 9/0229; F28F 9/0273; F28F 9/0229; F28F 9/0217; F28F 9/0253; F28F 9/0256; F28F 1/126; F28F 2275/12
See application file for complete search history.

(56) References Cited

U.S. PATENT DOCUMENTS 1,684,083 A * 9/1928 Bloom ..... F28F 9/0273 165/174
9,448,016 B2 * 9/2016 Wang ..... F16L 41/00
(Continued)

FOREIGN PATENT DOCUMENTS

CA 2596365 A1 8/2006
CN 103743158 A 4/2014
(Continued)

*Primary Examiner* — Eric S Ruppert
(74) *Attorney, Agent, or Firm* — Cheng-Ju Chiang

(57) ABSTRACT

A heat exchanger has a collecting pipe, a separator and a number of heat exchange tubes. The collecting pipe has a pipe wall and an inner cavity. The separator is provided in the inner cavity. The separator extends along a lengthwise direction of the collecting pipe. The separator divides the collecting pipe into a first cavity and a second cavity. The heat exchange tubes are arranged along the lengthwise direction. Each heat exchange tube has a first end and an inner cavity. The first end of the heat exchange tube sequentially passes through the pipe wall of the collecting pipe, the first cavity and the separator to be inserted into the second cavity. The inner cavity of the heat exchange tube is communicated with the second cavity. As a result, uniformity of refrigerant distribution in the heat exchanger is improved.

20 Claims, 6 Drawing Sheets

(56) References Cited

U.S. PATENT DOCUMENTS

| | | | | |
|---|---|---|---|---|
| 2011/0290465 | A1* | 12/2011 | Joshi | F28F 9/0273 165/175 |
| 2015/0027672 | A1* | 1/2015 | Jindou | F25B 39/028 62/526 |
| 2018/0283805 | A1* | 10/2018 | Matsunaga | F28F 9/0243 |

FOREIGN PATENT DOCUMENTS

| | | | | | |
|---|---|---|---|---|---|
| CN | 103983126 | A | | 8/2014 | |
| CN | 203810795 | U | | 9/2014 | |
| CN | 203824169 | U | * | 9/2014 | |
| CN | 104880115 | A | | 9/2015 | |
| CN | 206055926 | U | | 3/2017 | |
| CN | 207180448 | U | | 4/2018 | |
| CN | 108267042 | A | | 7/2018 | |
| DE | 3813339 | A1 | | 11/1989 | |
| GB | 790704 | A | * | 2/1958 | |
| JP | H09166368 | | * | 6/1997 | |
| JP | 2012-2475 | A | | 1/2012 | |
| WO | 2013/084469 | A1 | | 6/2013 | |
| WO | 2013/084472 | A1 | | 6/2013 | |
| WO | WO-2017057184 | A1 | * | 4/2017 | F28D 1/05383 |
| WO | 2020/063966 | A1 | | 4/2020 | |

* cited by examiner

HEAT EXCHANGER

CROSS-REFERENCE TO RELATED APPLICATIONS

This patent application is a bypass continuation of National Phase conversion of International (PCT) Patent Application No. PCT/CN2019/109050, filed on Sep. 29, 2019, which further claims priorities of a Chinese Patent Application No. 201811155651.2, filed on Sep. 30, 2018 and titled "HEAT EXCHANGER", and a Chinese Patent Application No. 201811155652.7, filed on Sep. 30, 2018 and titled "HEAT EXCHANGER", the entire content of which is incorporated herein by reference.

TECHNICAL FIELD

The present disclosure relates to a technical field of exchanging heat, in particular to a heat exchanger.

BACKGROUND

In related art, uniformity of refrigerant distribution in heat exchangers needs to be improved.

SUMMARY

For this reason, the present disclosure proposes a heat exchanger which is capable of improving uniformity of refrigerant distribution in the heat exchanger.

The heat exchanger according to embodiments of the present disclosure includes a collecting pipe having a pipe wall and an inner cavity; a baffle disposed in the inner cavity of the collecting pipe, the baffle extending along a length direction of the collecting pipe, the inner cavity of the collecting pipe being divided by the baffle into a first cavity and a second cavity; and a plurality of heat exchange tubes disposed along the length direction of the collecting pipe, each of the heat exchange tubes having a first end and an inner channel; wherein the first end of the heat exchange tube passes through the pipe wall of the collecting pipe, the first cavity and the baffle in sequence so that the inner channel of the heat exchange tube is in communication with the second cavity.

According to the heat exchanger of the embodiments of the present disclosure, by providing the baffle in the inner cavity of the collecting pipe to divide the collecting pipe into a first cavity and a second cavity, the first end of the heat exchange tube passes through the pipe wall of the collecting pipe, the first cavity and the baffle in sequence in order to be in communication with the second cavity. The refrigerant entering the second cavity of the collecting pipe from the fluid inlet can be evenly distributed to the plurality of heat exchange tubes. As a result, the uniformity of the refrigerant distribution in the heat exchanger can be improved.

Figure 1:
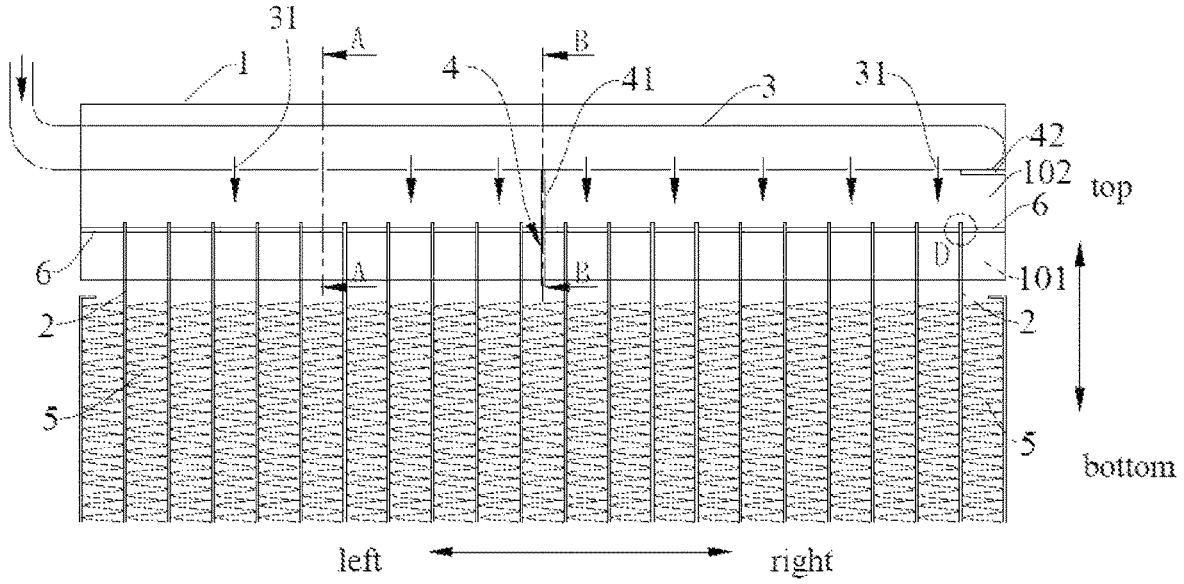
FIG. 1 is a schematic view of a heat exchanger in accordance with an embodiment of the present disclosure.

REFERENCE SIGNS collecting pipe 1, first cavity 101, second cavity 102, heat exchange tube 2, first end of the heat exchange tube 21, end surface of the first end of the heat exchange tube 211, distribution pipe 3, through hole 31, support assembly 4, first support 41, second support 42, fin 5, baffle 6, slot 61.

DETAILED DESCRIPTION

Embodiments of the present disclosure are described in detail below, and examples of the embodiments are shown in drawings. The embodiments described below with reference to the drawings are exemplary, and are intended to explain the present disclosure, but should not be understood as a limitation to the present disclosure. The exemplary embodiments will be described in detail here, and examples thereof are shown in the drawings. When the following description refers to the drawings, unless otherwise indicated, the same numbers in different drawings indicate the same or similar elements. The implementation embodiments described in the following exemplary embodiments do not represent all implementation embodiments consistent with the present disclosure. On the contrary, they are merely examples of devices and methods consistent with some aspects of the present disclosure as detailed in the appended claims.

The terms used in the present disclosure are only for the purpose of describing specific embodiments, and are not intended to limit the present disclosure. In the description of the present disclosure, it should be understood that the terms "center", "longitudinal", "transverse", "length", "width", "thickness", "upper", "lower", "front", ""rear", "left", "right", "vertical", "horizontal", "top", "bottom", "inner", "outer", "clockwise", "counterclockwise" and other directions or positional relationships are based on the positions or positional relationships shown in the drawings, and are only for the convenience of describing the disclosure and simplifying the description. It does not indicate or imply that the pointed devices or elements must have specific orientations, be constructed and operated in specific orientations, thereby it cannot be understood as a limitation of the present disclosure. In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of the present disclosure, "a plurality of" means two or more than two, unless otherwise specifically defined.

In the description of the present disclosure, it should be noted that, unless otherwise clearly specified and limited, the terms "installation", "connected" and "connection" should be understood in a broad meaning. For example, it can be a fixed connection, a detachable connection or an integral connection; it can be a mechanical connection or an electrical connection; it can be directly connected or indirectly connected through an intermediate medium, including the connection between two internal elements or the interaction between two elements. For those of ordinary skill in the art, the specific meanings of the above-mentioned terms in the present disclosure can be understood according to specific circumstances.

In the present disclosure, unless otherwise clearly defined and limited, a first feature located "upper" or "lower" of a second feature may include the first feature and the second feature are in direct contact with each other, or may include the first feature and the second feature are in direct contact but through other features therebetween. Moreover, the first feature located "above", "over" or "on top of" the second feature includes the first feature is directly above and obliquely above the second feature, or it simply means that the level of the first feature is higher than that of the second feature. The first feature located "below", "under" and "at bottom of" the second feature includes the first feature is directly below and obliquely below the second feature, or it simply means that the level of the first feature is lower than the second feature. The exemplary embodiments of the present disclosure will be described in detail below with reference to the drawings. In the case of no conflict, the following embodiments and features in the embodiments can be mutually supplemented or combined with each other.

The terms used in the present disclosure are only for the purpose of describing specific embodiments, and are not intended to limit the present disclosure. The singular forms of "a", "said" and "the" described in the present disclosure and appended claims are also intended to include plural forms, unless the context clearly indicates otherwise.

The exemplary embodiments of the present disclosure will be described in detail below with reference to the drawings. In the case of no conflict, the following embodiments and features in the embodiments can be combined with each other.

As shown in FIGS. 1 to 5, a heat exchanger in accordance with embodiments of the present disclosure includes a collecting pipe/manifold 1, a plurality of heat exchange tubes 2 and a baffle/partition 6. The collecting pipe 1 includes a pipe wall and an inner cavity. A cross section of the collecting pipe 1 is circular, that is, the collecting pipe 1 is a round pipe.

The baffle 6 is disposed in the inner cavity of the collecting pipe 1. The baffle 6 extends along a length direction of the collecting pipe 1 (a left-to-right direction shown in FIG. 1) to divide the inner cavity of the collecting pipe 1 into a first cavity 101 and a second cavity 102. In other words, the inner cavity of the collecting pipe 1 includes the first cavity 101 and the second cavity 102 which both extend along the length direction of the collecting pipe 1.

There are a plurality of the heat exchange tubes 2. The plurality of the heat exchange tubes 2 are spaced apart from each other along the length direction of the collecting pipe 1 (the left-to-right direction shown in FIG. 1). Optionally, the plurality of the heat exchange tubes 2 are disposed at even intervals along the length direction of the collecting pipe 1, meaning distances between adjacent heat exchange tubes 2 are equal.

Each heat exchange tube 2 has a first end 21 and an inner channel. The first end 21 of the heat exchange tube 2 passes through the pipe wall of the collecting pipe 1, the first cavity 101 and the baffle 6 in sequence, and is inserted into the second cavity 102. The inner channel of the heat exchange tube 2 is in communication with the second cavity 102. In the description of the present disclosure, "a plurality of" means at least two, such as two, three, etc., unless otherwise specifically defined.

According to the heat exchanger of the embodiment of the present disclosure, by providing the baffle 6 in the inner cavity of the collecting pipe 1 to divide the collecting pipe 1 into the first cavity 101, the first end 21 of the heat exchange tube 2 is inserted into the second cavity 102 through the pipe wall of the collecting pipe 1, the first cavity 101 and the baffle 6 in sequence, therefore, the refrigerant entering the second cavity 102 from the fluid inlet can be evenly distributed to the plurality of heat exchange tubes 2, thereby improving the heat exchange efficiency.

The heat exchange tube 2 may be a flat tube which is also known as a microchannel flat tube in the industry. The use of the flat tubes is beneficial to reduce weight and size of air conditioners. Among them, an inside of the flat tube usually includes a plurality of channels/micro-channels for the flow of refrigerant. Adjacent channels are separated from each other. The plurality of the channels are disposed in a row, which together affect a width of the flat tube. The flat tube is flat as a whole, its length is greater than its width, and its width is greater than its thickness. A length direction of the flat tube is the direction of refrigerant flow determined by the channels in the flat tubes. The length direction of the flat tube can be straight, folded or curved. The flat tube mentioned here is not limited to these types and may be of other forms. For example, adjacent channels may not be completely separated. For another example, all the channels can be disposed in two rows, as long as the width thereof is still greater than the thickness thereof.

Figure 4:
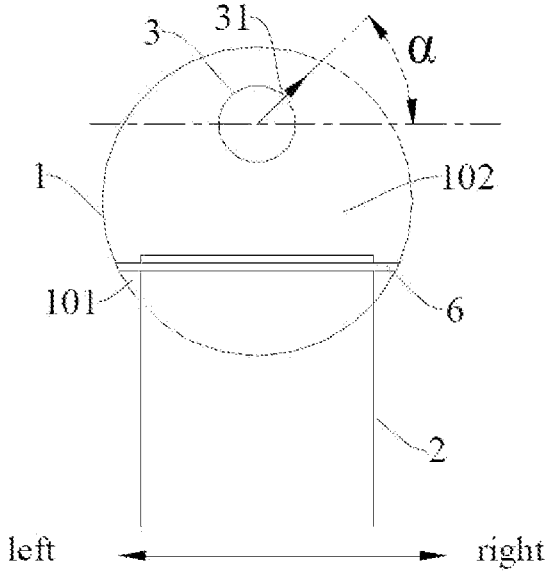
FIG. 4 is a schematic cross-sectional view taken along line A-A in FIG. 1 of the heat exchanger in accordance with an embodiment of the present disclosure.

Optionally, the collecting pipe 1 is placed horizontally and has a length greater than 250 mm. The heat exchange tubes 2 are placed vertically. A diameter of the collecting pipe 1 is greater than a width of the heat exchange tube 2 so that the first end 21 of the heat exchange tube 2 can be completely located in the inner cavity of the collecting pipe 1 in its width direction. Here, it should be understood that, as shown in FIG. 4, the left-to-right direction is defined as a width direction of the heat exchange tube 2.

Figure 2:
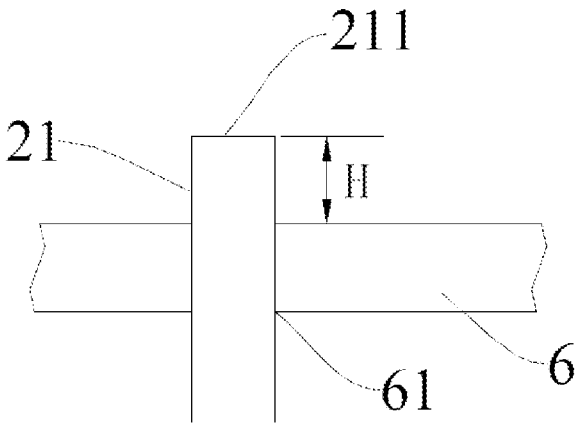
FIG. 2 is a partial enlarged schematic view of the heat exchanger at a portion D in FIG. 1 in accordance with the embodiment of the present disclosure.
Figure 3:
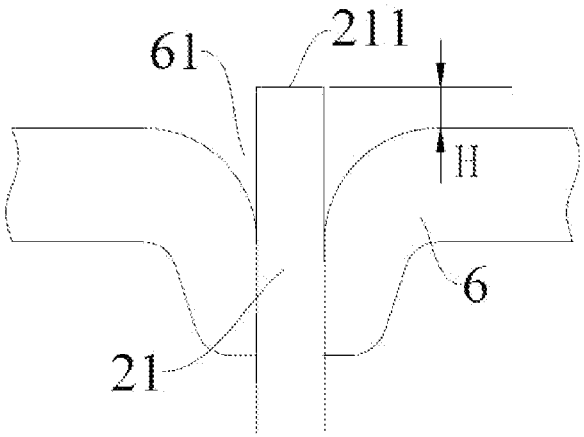
FIG. 3 is a partial enlarged schematic view of the heat exchanger at the portion D in FIG. 1 in accordance with another embodiment of the present disclosure.

In some embodiments, as shown in FIGS. 1 to 3, a distance between the first end 21 of the heat exchange tube 2 and the baffle 6 is 0 mm to 5 mm. Optionally, the distance between the first end 21 of the heat exchange tube 2 and the baffle 6 is 0 mm to 2 mm. Here, it should be understood that the distance between the first end 21 of the heat exchange tube 2 and the baffle 6 is a vertical distance between an end surface 211 (an upper end face of the heat exchange tube 2 shown in FIG. 1) of the first end 21 of the heat exchange tube 2 and a surface (an upper surface of the baffle 6 shown in FIG. 1) of the baffle 6 adjacent to the second cavity 102. That is, a depth of the first end of the heat exchange tube 2 extending into the second cavity 102 is 0 mm to 2 mm.

In some embodiments, the heat exchanger further includes fins 5 disposed between adjacent heat exchange tubes 2. As a result, heat exchange is performed with the heat exchange tubes 2 through the fins 5, thereby improving the heat exchange efficiency. Specifically, the plurality of heat exchange tubes 2 are spaced apart from each other. The fins 5 are disposed in the gaps between the adjacent heat exchange tubes 2, and the fins 5 are at least partially connected to the heat exchange tubes 2.

In some embodiments, the pipe wall of the collecting pipe 1 includes a plurality of insertion holes extending through the pipe wall of the collecting pipe 1. The plurality of insertion holes are disposed along the length direction of the collecting pipe 1 (the left-to-right direction shown in FIG. 1), and the adjacent insertion holes are spaced apart from each other. The baffle 6 includes a plurality of slots 61 extending through the baffle 6 along a thickness direction of the baffle 6. The plurality of slots 61 are disposed at intervals along a length direction of the baffle 6. In addition, the plurality of slots 61 and the plurality insertion holes are disposed in a one-to-one correspondence manner, that is, one slot 61 is in alignment with one insertion hole. The slots 61 are in communication with the first cavity 101 and the second cavity 102. The first end of the heat exchange tube 2 is inserted into the second cavity 102 through the insertion hole, the first cavity 101 and the slot 61 in sequence.

Optionally, as shown in FIG. 3, a flanging is performed by means of stamping at the slots 61 in a direction (a top-to-bottom direction as shown in FIGS. 1 and 3) from the second cavity 102 toward the first cavity 101.

In some embodiments, the heat exchanger further includes a distribution pipe 3 having a first end (a left end of the distribution pipe 3 shown in FIG. 1) and a second end (a right end of the distribution pipe 3 shown in FIG. 1). The collecting pipe 1 has a first end (a left end of the collecting pipe 1 shown in FIG. 1) and a second end (a right end of the collecting pipe 1 shown in FIG. 1). The first end of the distribution pipe 3 is a fluid inlet so as to facilitate the flow of refrigerant into the distribution pipe 3. The second end of the distribution pipe 3 is closed and extends into the second cavity 102 from the first end of the collecting pipe 1. It can be understood that, in order to distribute the refrigerant smoothly, the distribution pipe 3 is located above the heat exchange tube 2. Optionally, the distribution pipe 3 is spaced apart from the first end 21 of the heat exchange tube 2 by a certain distance. In other embodiments, the distribution pipe 3 is at least partially in contact with the first end of the heat exchange tube 2.

The distribution pipe 3 includes a pipe wall and an inner space. The pipe wall of the distribution pipe 3 has a through hole 31 in communication with the second cavity 102 and the inner space of the distribution pipe 3. In other words, as shown in FIG. 1, the left end of the distribution pipe 3 is on the left side of the collecting pipe 1. The right end of the distribution pipe 3 extends into the second cavity 102 from the left end of the collecting pipe 1. The right end of the distribution pipe 3 is closed. The through hole 31 extends through the pipe wall of the distribution pipe 3 along a thickness direction of the pipe wall. The through hole 31 is in communication with the inner space of the distribution pipe 3 and the second cavity 102. The distribution pipe 3 is higher than the first end 21 of the heat exchange tube 2 in a top-to-bottom direction. It can be understood that the refrigerant flowing into the distribution pipe 3 through the first end of the distribution pipe 3 flows to the second end of the distribution pipe 3. The refrigerant in the distribution pipe 3 flows into the second cavity 102 through the through hole 31. In the present disclosure, the terms "first" and "second" are only used for descriptive purposes, and cannot be understood as indicating or implying relative importance or implicitly indicating the number of indicated technical features.

Optionally, a length of the distribution pipe 3 in the second cavity 102 is substantially the same as a length of the collecting pipe 1. Specifically, the second end of the distribution pipe 3 extends from the first end of the collecting pipe 1 into the second cavity 102, and extends to the second end of the collecting pipe 1. As shown in FIG. 1, the right end of the distribution pipe 3 extends from the left end of the collecting pipe 1 into the second cavity 102, extends to the right and extends to the right end of the collecting pipe 1.

In some embodiments, as shown in FIG. 4, the through hole 31 may be opened at any position of the distribution pipe 3 along a circumference of the distribution pipe 3. That is, the through hole 31 may be opened at any position along a circumferential direction of the distribution pipe 3 for one rotation. In other words, as shown in FIG. 4, on a cross section of the distribution pipe 3 with the through hole 31, a straight line with a horizontal diameter of the distribution pipe 3 is defined as a horizontal line. The through hole 31 may be located above the horizontal line, and an angle $\alpha$ between a connection line connecting a center of the through hole 31 and a center of the distribution pipe 3, and the horizontal line is $0°<\alpha<180°$. The through hole 31 may also be located below the horizontal line, and the angle $\alpha$ between the connection line connecting the center of the through hole 31 and the center of the distribution pipe 3, and the horizontal line is $0°<\alpha<180°$.

In some embodiments, a plurality of through holes 31 are provided, and the plurality of through holes 31 are disposed at intervals along the length direction of the distribution pipe 3 (the left-to-right direction shown in FIG. 1). It can be understood that by providing the plurality of through holes 31 spaced apart from each other along the length of the distribution pipe 3 on the pipe wall of the distribution pipe 3, the refrigerant in the distribution pipe 3 can evenly flow into the second cavity 102.

In some optional embodiments, the plurality of through holes 31 include a first through hole, a second through hole, a third through hole, . . . an $(n-1)^{th}$ through hole and an $n^{th}$ through hole in sequence from the first end of the distribution pipe 3 toward the second end of the distribution pipe 3 (a left-to-right direction as shown in FIG. 1), wherein a distance between an $(i+1)^{th}$ through hole and an $i^{th}$ through hole is:

$d_i=\alpha^i L_0$, $i=1, 2, \ldots n-1$, $\alpha=0.618$, $L_0$ is a distance between adjacent heat exchange tubes 2.

For example, a distance between the second through hole and the first through hole is: $d_1=\alpha^1 L_0$, and a distance between the third through hole and the second through hole is: $d_2=\alpha^2 L_0$. Here, it should be understood that the first through hole is the through hole 31 of the distribution pipe 3 closest to the fluid inlet. As shown in FIG. 1, the first through hole is the leftmost through hole 31.

In some specific embodiments, the plurality of heat exchange tubes 2 include a first heat exchange tube, a second heat exchange tube, a third heat exchange tube, a fourth heat exchange tube etc., disposed in sequence from the first end of the distribution pipe 3 toward the second end of the distribution pipe 3 (the left-to-right direction as shown in FIG. 1). The first through hole is located between the third heat exchange tube and the fourth heat exchange tube. Here, the first heat exchange tube is the heat exchange tube 2 closest to the fluid inlet. As shown in FIG. 1, the first heat exchange tube is the leftmost heat exchange tube 2. In other words, the through hole 31 closest to the fluid inlet is opened between the third heat exchange tube and the fourth heat exchange tube.

In other alternative embodiments, from the first end of the collecting pipe 1 (the left end of the collecting pipe 1 shown in FIG. 1) to a middle position of the collecting pipe 1 along the length direction. The distribution pipe 3 includes a plurality of through holes 31. The plurality of through holes 31 are disposed at even intervals along the length direction of the distribution pipe 3 (the left-to-right direction shown in FIG. 1). A distance between adjacent through holes 31 is $d=2.5L_0$, in which $L_0$ is a distance between adjacent heat exchange tubes 2. From the middle position of the collecting pipe 1 along the length direction to the second end of the collecting pipe 1 (the right end of the collecting pipe 1 shown in FIG. 1), the distribution pipe 3 includes a plurality of through holes 31. The plurality of through holes 31 include a first through hole, a second through hole, a third through hole . . . an $(n-1)^{th}$ through hole and an $n^{th}$ through hole along a direction from the middle position of the collecting pipe 1 toward the second end of the collecting pipe 1 sequentially, wherein a distance between an $(i+1)^{th}$ through hole and an $i^{th}$ through hole is:

$d_i=2.5\alpha^i L_0$, $i=1, 2, \ldots n-1$, $\alpha=0.618$, $L_0$ is a distance between adjacent heat exchange tubes 2.

Optionally, the through hole 31 is a round hole. If $d_i<D_0$, then $d_i=D_0+2$, $D_0$ is a diameter of the through hole 31. Specifically, 1 mm$<D_0<$3 mm.

Here, it can be understood that the middle position of the collecting pipe 1 along the length direction is half the length of the collecting pipe 1, for example the position B-B as shown in FIG. 1.

Figure 5:
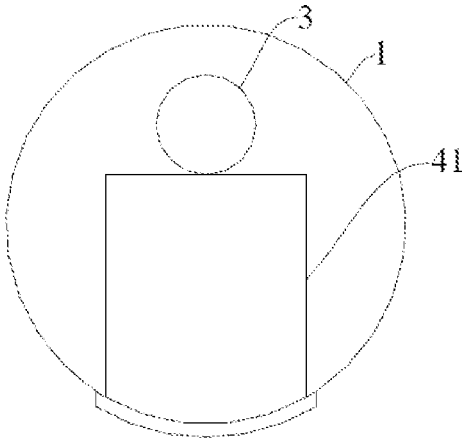
FIG. 5 is a schematic cross-sectional view taken along line B-B in FIG. 1 of the heat exchanger in accordance with an embodiment of the present disclosure.

In some embodiments, as shown in FIGS. 1 and 5, the heat exchanger further includes a support assembly 4. The support assembly 4 includes a first support 41 and a second support 42. The first support 41 has a first end (a lower end of the first support 41 shown in FIG. 5) and a second end (an upper end of the first support 41 shown in FIG. 5). The distribution pipe 3 has an outer peripheral surface. The first end of the first support 41 is connected to the collecting pipe 1. The second end of the first support 41 is located below the distribution pipe 3 and is in contact with the outer peripheral surface of the distribution pipe 3. Therefore, the distribution pipe 3 is supported by the first support 41. It can be understood that the arrangement form of the first support 41 is not limited to this. For example, in some optional embodiments, the second end of the first support 41 may also be located below the distribution pipe 3 and connected to the distribution pipe 3. In other alternative embodiments, the first support 41 may be located above the distribution pipe 3. The upper end of the first support 41 is connected to the collecting pipe 1. The lower end of the first support 41 is connected to the distribution pipe 1.

Specifically, a plurality of the first supports 41 are provided. The plurality of first supports 41 are disposed at intervals from each other along the length direction of the collecting pipe 1 (the left-to-right direction shown in FIG. 1). Therefore, the distribution pipe 3 is jointly supported by the plurality of first supports 41. It can be understood that the present disclosure is not limited to this, and there may be only one first support 41 which is located at the middle position of the collecting pipe 1 along the length direction.

In some specific embodiments, the first end of the first support 41 (the lower end of the first support 41 shown in FIG. 5) is connected to the outer peripheral surface of the collecting pipe 1. The second end of the first support 41 (the upper end of the first support 41 shown in FIG. 5) passes through the pipe wall of the collecting pipe 1, the first cavity 101 and the baffle 6 in sequence from the outer peripheral surface of the collecting pipe 1 and extends into the second cavity 102. The second end of the first support 41 is in contact with the outer peripheral surface of the distribution pipe 3. Specifically, as shown in FIG. 5, the first support 41 includes a first section and a second section which are sequentially disposed along the top-to-bottom direction and connected to each other. The first section is in the inner cavity of the collecting pipe 1 and passes through the baffle 6 along a bottom-to-top direction so as to contact the outer peripheral surface of the distribution pipe 3. The second section is attached to the outer peripheral surface of the collecting pipe 1.

In some embodiments, the support assembly 4 further includes a second support 42. The second support 42 extends into the second cavity 102 from the second end of the collecting pipe 1 (the right end of the collecting pipe 1 shown in FIG. 1). The second support 42 is located below the distribution pipe 3 and is in contact with the outer peripheral surface of the distribution pipe 3. It can be understood that the arrangement form of the second support 42 is not limited to this. For example, in some alternative embodiments, the second support 42 is located below the distribution pipe and is connected to the outer peripheral surface of the distribution pipe 3. In other alternative embodiments, the second support 42 is located above the distribution pipe 3 and is connected to the outer peripheral surface of the distribution pipe 3. It is understandable that the present disclosure is not limited to this. For example, when the second end of the distribution pipe 3 is welded to the second end of the inner cavity of the collecting pipe 1, the support assembly 4 may not be provided with the second support 42. In the illustrated embodiment of the present disclosure, by providing the first support 41 and the second support 42 at the same time, the distribution pipe 3 can be better supported and positioned. It makes the distribution pipe 3 more fixed, and it is not easy to shift during the manufacturing and assembly processes.

Hereinafter, a heat exchanger according to a specific embodiment of the present disclosure will be described with FIGS. 1 to 5.

As shown in FIGS. 1 to 5, the heat exchanger according to the embodiment of the present disclosure includes a collecting pipe 1, a plurality of heat exchange tubes 2, a distribution pipe 3, a support assembly 4, fins 5 and a baffle 6. The collecting pipe 1 is placed horizontally, that is, it extends in the left-to-right direction. A length of the collecting pipe 1 is greater than 250 mm. A cross section of the collecting pipe 1 is circular, that is, the collecting pipe 1 is a round pipe. The pipe wall of the collecting pipe 1 includes a plurality of insertion holes extending through the pipe wall of the collecting pipe 1 along a thickness direction of the pipe wall of the collecting pipe 1. The thickness direction is a vertical direction. The plurality of insertion holes are disposed at intervals along a length direction of the collecting pipe 1, meaning a left-to-right direction shown in FIG. 1. Distances between adjacent insertion holes are equal.

The baffle 6 is disposed in the inner cavity of the collecting pipe 1. The baffle 6 extends along a length direction of the collecting pipe 1 (a left-to-right direction shown in FIG. 1) to divide the inner cavity of the collecting pipe 1 into a first cavity 101 and a second cavity 102. The baffle 6 includes a plurality of slots 61 extending through the baffle 6 along a thickness direction of the baffle 6. The plurality of slots 61 are disposed at intervals along a length direction of the baffle 6. The plurality of slots 61 and the plurality of insertion holes are disposed in a one-to-one correspondence manner. That is, one slot 61 is in alignment with one insertion hole. The slots 61 are in communication with the first cavity 101 and the second cavity 102. Specifically, a flanging is performed by means of stamping at the slots 61 in a direction (a top-to-bottom direction as shown in FIGS. 1 and 3) from the second cavity 102 toward the first cavity 101.

The heat exchange tube 2 is a flat tube. A plurality of heat exchange tubes 2 are provided. The plurality of heat exchange tubes 2 are disposed in sequence along the length direction of the collecting pipe 1 and are spaced apart from each other. Distances between adjacent heat exchange tubes 2 are equal. The first end 21 (an upper end shown in FIG. 1) of each heat exchange tube 2 is inserted into the second cavity 102 through the insertion hole, the first cavity 101 and the slot 61 sequentially along a bottom-to-top direction. An inner channel of the heat exchange tube 2 is in communication with the second cavity 102. One heat exchange tube 2 corresponds to one insertion hole. A distance between the end surface 211 of the first end 21 of the heat exchange tube 2 and an upper surface of the baffle 6 is 0 mm to 2 mm. That is, the first end 21 of the heat exchange tube 2 extends into the second cavity by a depth of 0 mm to 2 mm.

The fins 5 are disposed in gaps between the adjacent heat exchange tubes 2, and the fins 5 are at least partially connected with the heat exchange tubes 2 so as to improve the heat exchange efficiency.

The left end of the distribution pipe 3 is a fluid inlet so as to facilitate the flow of refrigerant into the distribution pipe 3. The right end of the distribution pipe 3 extends into the second cavity 102. The right end of the distribution pipe 3 extends to the right end of the collecting pipe 1 and the right end of the distribution pipe 3 is closed. The pipe wall of the distribution pipe 3 includes a through hole 31 extending through the pipe wall of the distribution pipe 3. The through hole 31 is a round hole. A diameter of the through hole 31 is $D_0$, where 1 mm$<D_0<$3 mm. The inner space of the distribution pipe 3 and the second cavity 102 are communicated with each other through the through hole 31. That is, the refrigerant in the inner space of the distribution pipe 3 can enter the second cavity 102 through the through hole 31 and further enters each heat exchange tube 2. An outer peripheral surface of the distribution pipe 3 is spaced apart from the end surface 211 of the first end 21 of the heat exchange tube 2 along the top-to-bottom direction.

The through hole 31 may be opened at any position of the distribution pipe 3 along a circumference of the distribution pipe 3. In other words, the through hole 31 may be opened at any position along a circumferential direction of the distribution pipe 3 for one rotation.

Among them, from the left end of the collecting pipe 1 to a middle position of the collecting pipe 1 in the length direction, the distribution pipe 3 includes a plurality of through holes 31. The plurality of through holes 31 are disposed at even intervals along the left-to-right direction shown in FIG. 1. A distance between adjacent through holes 31 is $d=2.5L_0$, where $L_0$ is a distance between adjacent heat exchange tubes 2.

Among them, from the middle position along the length of the collecting pipe 1 to the right end of the collecting pipe 1, the distribution pipe 3 includes a plurality of through holes 31. The plurality of through holes 31 include a first through hole, a second through hole, a third through hole, . . . an $(n-1)^{th}$ through hole and an $n^{th}$ through hole in sequence from the middle position of the collecting pipe 1 toward the second end of the collecting pipe 1, wherein a distance between an $(i+1)^{th}$ through hole and an $i^{th}$ through hole is:

$d_i=2.5\alpha^i L_0$, i=1, 2, . . . n−1, $\alpha=0.618$, $L_0$ is a distance between adjacent heat exchange tubes 2.

In addition, if $d_i<D_0$, then $d_i=D_0+2$, $D_0$ is a diameter of the through hole 31. Through this formula, a relatively regular design can be used to achieve more uniform flow distribution.

The support assembly 4 includes a first support 41 and a second support 42. A lower end of the first support 41 is connected to the outer peripheral surface of the collecting pipe 1. An upper end of the first support 41 extends from the outer peripheral surface of the collecting pipe 1 through the pipe wall of the collecting pipe 1, the first cavity 101 and the baffle 6 and then extends into the second cavity 102. The upper end of the first support 41 is in contact with the outer peripheral surface of the distribution pipe 3. The first support 41 is located at the middle position of the collecting pipe 1 along the length direction to support the distribution pipe 3 at the middle position of the collecting pipe 1 along the length direction. The second support 42 extends into the second cavity 102 from the right end of the collecting pipe 1. The upper surface of the second support 42 is in contact with the outer peripheral surface of the distribution pipe 3 so as to support the distribution pipe 3 at the right end of the distribution pipe 3.

FIGS. 6 to 9 show another embodiment of the heat exchanger of the present disclosure. It should be noted that the same reference numerals in the another embodiment as in the embodiment in FIGS. 1 to 5 represent the same elements. Unless otherwise specified, the positional relationship and matching relationship among the same elements are also the same.

Figure 6:
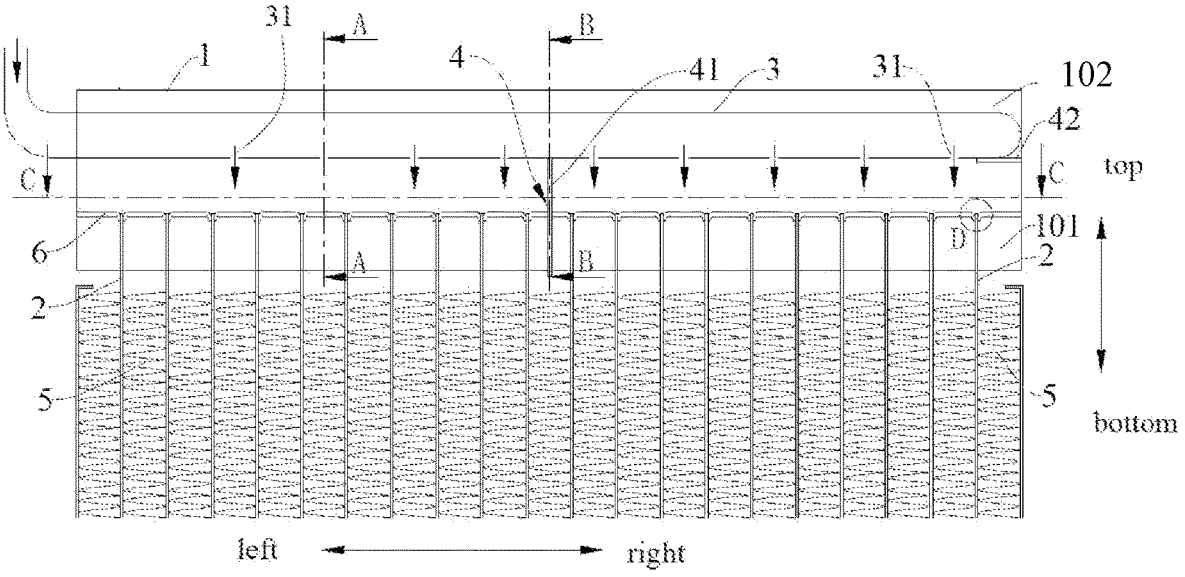
FIG. 6 is a schematic view of the heat exchanger in accordance with another embodiment of the present disclosure.
Figure 7:
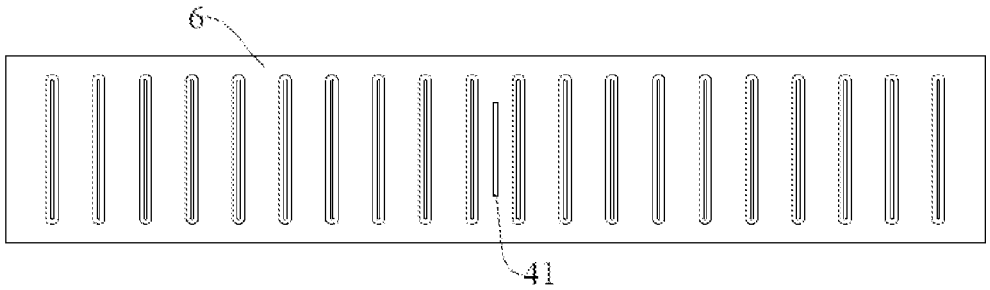
FIG. 7 is a schematic cross-sectional view taken along line C-C in FIG. 6.
Figure 8:
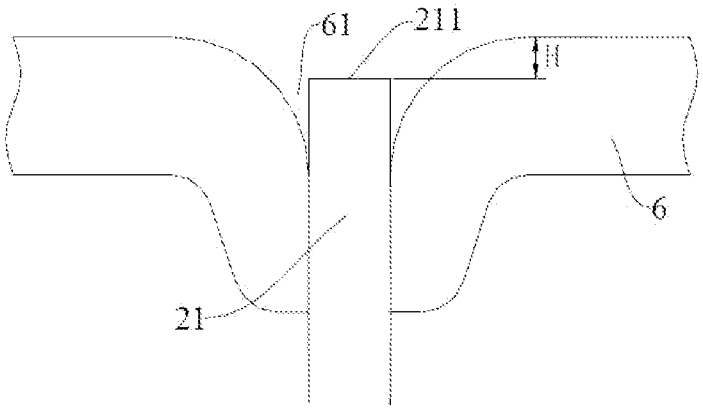
FIG. 8 is a partial enlarged schematic view of a portion D in FIG. 6.
Figure 9:
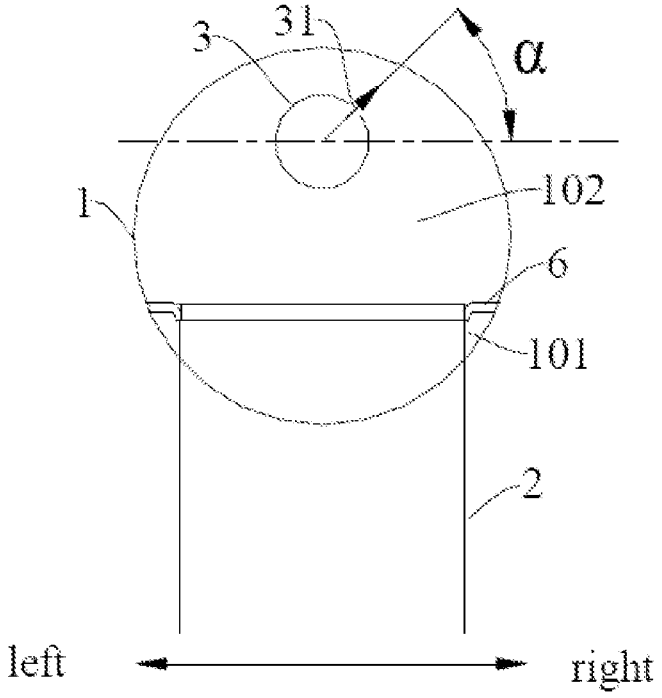
FIG. 9 is a schematic cross-sectional view taken along line A-A in FIG. 6.

Referring to FIGS. 6 to 9, each heat exchange tube 2 has a first end 21 and an inner channel. The first end 21 of the heat exchange tube 2 (an upper end of the heat exchange tube 1 shown in FIG. 6) sequentially extends through the pipe wall of the collecting pipe 1 and the first cavity 101, and extends into the slot 61. The first end 21 of the heat exchange tube 2 does not protrude beyond a surface of the baffle 6 (an upper surface of the baffle 6 shown in FIG. 6) adjacent to the second cavity 102. That is, the first end 21 of the heat exchange tube 2 is not inserted in the second cavity 102. The inner channel of the heat exchange tube 2 is in communication with the second cavity 102 through the slot 61. Specifically, a flanging is performed by means of stamping at the slots 61 in a direction (a top-to-bottom direction as shown in FIGS. 6 and 8) from the second cavity 102 toward the first cavity 101. In addition, a cross-sectional schematic view along line B-B in FIG. 6 is the same as that in FIG. 5, in which the positional relationship and matching relationship among the corresponding components can be referred to the previous description and they will not be repeated here.

In some embodiments, a distance between the first end 21 of the heat exchange tube 2 and the surface of the baffle 6 (the upper surface of the baffle 6 shown in FIG. 6) adjacent to the second cavity 102 is 0 mm to 5 mm. Optionally, the distance between the first end 21 of the heat exchange tube 2 and the surface of the baffle 6 adjacent to the second cavity 102 is 0 mm to 2 mm. Here, it should be understood that the distance between the first end 21 of the heat exchange tube 2 and the surface of the baffle 6 adjacent to the second cavity 102 is a vertical distance between an end surface 211 (an upper end face of the heat exchange tube 2 shown in FIG. 6) of the first end 21 of the heat exchange tube 2 and a surface (an upper surface of the baffle 6 shown in FIG. 6) of the baffle 6 adjacent to the second cavity 102.

In some embodiments, the pipe wall of the collecting pipe 1 includes a plurality of insertion holes extending through the pipe wall of the collecting pipe 1. The plurality of insertion holes are spaced apart from each other along the length direction of the collecting pipe 1 (the left-to-right direction shown in FIG. 6). The plurality of slots 61 and the plurality of insertion holes are disposed in a one-to-one correspondence manner. That is, one slot 61 is in alignment with one insertion hole. The first end of the heat exchange tube 2 passes through the insertion hole and the first cavity 101 in sequence, and extends into the slot 61.

The heat exchanger according to another specific embodiment of the present disclosure will be described below with reference to FIGS. 6 to 9.

As shown in FIGS. 6 to 9, the heat exchanger in accordance with another embodiment of the present disclosure includes a collecting pipe 1, a plurality of heat exchange tubes 2, a distribution pipe 3, a support assembly 4, fins 5 and a baffle 6. The collecting pipe 1 is placed horizontally, meaning it extends in a left-to-right direction. A length of the collecting pipe 1 is greater than 250 mm. A cross section of the collecting pipe 1 is circular, that is, the collecting pipe 1 is a round pipe. The pipe wall of the collecting pipe 1 includes a plurality of insertion holes extending through the pipe wall of the collecting pipe 1 along a thickness direction of the pipe wall of the collecting pipe 1. The thickness direction is a vertical direction. The plurality of insertion holes are disposed at intervals along the length direction of the collecting pipe 1. The length direction is the left-to-right direction shown in FIG. 6. Distances between adjacent insertion holes are equal.

The baffle 6 is disposed in the inner cavity of the collecting pipe 1. The baffle 6 extends along the length direction of the collecting pipe 1 (the left-to-right direction shown in FIG. 6) to divide the inner cavity of the collecting pipe 1 into a first cavity 101 and a second cavity 102. The baffle 6 includes a plurality of slots 61 extending through the baffle 6 along a thickness direction of the baffle 6. A flanging is performed by means of stamping at the slots 61 in the top-to-bottom direction from the second cavity 102 toward the first cavity 101, so that the slot 61 has a vertical side extending downwardly. The plurality of slots 61 are disposed at intervals along the length direction of the baffle 6. The plurality of slots 61 and the plurality of insertion holes are disposed in a one-to-one correspondence manner. That is, one slot 61 is in alignment with one insertion hole. The slot 61 is in communication with the first cavity 101 and the second cavity 102.

The heat exchange tube 2 is a flat tube. A plurality of heat exchange tubes 2 are provided. The plurality of heat exchange tubes 2 are disposed in sequence along the length direction of the collecting pipe 1 and are spaced apart from each other. Distances between adjacent heat exchange tubes 2 are equal. The first end 21 (the upper end shown in FIG. 6) of each heat exchange tube 2 passes through the insertion hole and the first cavity 101 sequentially along the bottom-to-top direction, and extends into the vertical side formed by the flange of the slot 61. The first end 21 of the heat exchange tube 2 is not inserted into the second cavity 102. The inner channel of the heat exchange tube 2 is in communication with the second cavity 102 through the slot 61. One heat exchange tube 2 corresponds to one insertion hole. A distance between the end surface 211 of the first end 21 of the heat exchange tube 2 and the upper surface of the baffle 6 is 0 mm to 2 mm.

The fins 5 are disposed in gaps between the adjacent heat exchange tubes 2, and the fins 5 are at least partially connected with the heat exchange tubes 2 so as to improve the heat exchange efficiency.

The left end of the distribution pipe 3 is a fluid inlet so as to facilitate the flow of refrigerant into the distribution pipe 3. The right end of the distribution pipe 3 extends into the second cavity 102. The right end of the distribution pipe 3 extends to the right end of the collecting pipe 1 and the right end of the distribution pipe 3 is closed. The pipe wall of the distribution pipe 3 includes a through hole 31 extending through the pipe wall of the distribution pipe 3. The through hole 31 is a round hole. A diameter of the through hole 31 is $D_0$, where 1 mm$<D_0<$3 mm. The inner space of the distribution pipe 3 and the second cavity 102 are communicated with each other through the through hole 31. That is, the refrigerant in the inner space of the distribution pipe 3 can enter the second cavity 102 through the through hole 31 and further enters each heat exchange tube 2. An outer peripheral surface of the distribution pipe 3 is spaced apart from the end surface 211 of the first end 21 of the heat exchange tube 2 along the top-to-bottom direction.

The through hole 31 may be opened at any position of the distribution pipe 3 along a circumference of the distribution pipe 3. In other words, the through hole 31 may be opened at any position along a circumferential direction of the distribution pipe 3 for one rotation.

Among them, from the left end of the collecting pipe 1 to a middle position of the collecting pipe 1 in the length direction, the distribution pipe 3 includes a plurality of through holes 31. The plurality of through holes 31 are disposed at even intervals along the left-to-right direction shown in FIG. 6. A distance between adjacent through holes 31 is $d=2.5L_0$, where $L_0$ is a distance between adjacent heat exchange tubes 2.

Among them, from the middle position along the length of the collecting pipe 1 to the right end of the collecting pipe 1, the distribution pipe 3 includes a plurality of through holes 31. The plurality of through holes 31 include in sequence from the middle position of the collecting pipe 1 toward the second end of the collecting pipe 1 a first through hole, a second through hole, a third through hole, . . . an $(n-1)^{th}$ through hole and an $n^{th}$ through hole, where a distance between an $(i+1)^{th}$ through hole and an $i^{th}$ through hole is:

$d_i=2.5\alpha_i L_0$, i=1, 2, . . . n−1, $\alpha=0.618$, $L_0$ is a distance between adjacent heat exchange tubes 2.

In addition, if $d_i<D_0$, then $d_i=D_0+2$, $D_0$ is a diameter of the through hole 31.

The support assembly 4 includes a first support 41 and a second support 42. A lower end of the first support 41 is connected to the outer peripheral surface of the collecting pipe 1. An upper end of the first support 41 passes through the pipe wall of the collecting pipe 1, the first cavity 101 and the baffle 12 in sequence from the outer peripheral surface of the collecting pipe 1, and extends into the second cavity 102. The upper end of the first support 41 is in contact with the outer peripheral surface of the distribution pipe 3. The first support 41 is located at the middle position of the collecting pipe 1 in the length direction so as to support the distribution pipe 3 in the middle position of the collecting pipe 1 in the length direction. The second support 42 extends into the second cavity 102 from the right end of the collecting pipe 1. The upper surface of the second support 42 is in contact with the outer peripheral surface of the distribution pipe 3 so as to support the distribution pipe 3 at the right end of the distribution pipe 3.

In the description of this specification, descriptions with reference to the terms "an embodiment", "some embodiments", "examples", "specific examples", or "some examples" etc., mean that the specific features, structures, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics can be combined in any one or more embodiments or examples in a suitable manner. In addition, those skilled in the art can combine and combine the different embodiments or examples and the features of the different embodiments or examples described in this specification without contradicting each other.

Although the embodiments of the present disclosure have been shown and described above, it can be understood that the above embodiments are exemplary and should not be construed as limiting the present disclosure. Those of ordinary skill in the art can make changes, modifications, substitutions and varieties to the above-mentioned embodiments within the scope of the present disclosure.

What is claimed is:

1. A heat exchanger, comprising:

a collecting pipe having a pipe wall and an inner cavity;

a baffle disposed in the inner cavity of the collecting pipe, the baffle extending along a length direction of the collecting pipe, the inner cavity of the collecting pipe being divided by the baffle into a first cavity and a second cavity, the baffle defining a plurality of slots extending through the baffle along a thickness direction of the baffle, the baffle comprising a first surface exposed to the first cavity and a second surface exposed to the second cavity, the first surface and the second surface being opposite to each other; and a plurality of heat exchange tubes disposed along the length direction of the collecting pipe, each of the heat exchange tubes having a first end and an inner channel;

wherein the pipe wall of the collecting pipe defines a plurality of insertion holes which are disposed along the length direction of the collecting pipe; the plurality of slots and the plurality of insertion holes are disposed in a one-to-one correspondence manner; the first end of each heat exchange tube is inserted into a corresponding slot of the baffle, without protruding beyond the second surface of the baffle, through a corresponding insertion hole and the first cavity in sequence, so that the inner channel of each heat exchange tube is in communication with the second cavity via the corresponding slot;

the baffle comprises a plurality of flanges extending in a direction from the second cavity toward the first cavity and protruding beyond the first surface, each flange is surrounded around the corresponding slot, and each heat exchange tube is fastened to the flange.

2. The heat exchanger according to claim 1, wherein a distance between the first end of the heat exchange tube and the second surface of the baffle is greater than 0 mm and less than or equal to 5 mm.

3. The heat exchanger according to claim 2, wherein the distance between the first end of the heat exchange tube and the second surface of the baffle is greater than 0 mm and less than or equal to 2 mm.

4. The heat exchanger according to claim 1, further comprising a distribution pipe, the distribution pipe having a first end, a second end, a pipe wall and an inner space, the collecting pipe comprising a first end and a second end, the first end of the distribution pipe being a fluid inlet, the second end of the distribution pipe being closed and extending into the second cavity from the first end of the collecting pipe, the pipe wall of the distribution pipe defining a through hole in communication with the second cavity and the inner space of the distribution pipe.

5. The heat exchanger according to claim 4, wherein a plurality of the through holes are provided, and the through holes are disposed along a length direction of the distribution pipe.

6. The heat exchanger according to claim 4, wherein the through holes may be opened at any position of the distribution pipe along a circumferential direction of the distribution pipe.

7. The heat exchanger according to claim 4, further comprising a support assembly having a first support, the first support having a first end and a second end, the distribution pipe having an outer peripheral surface, the first end of the first support being connected to the collecting pipe, the second end of the first support being adapted to support the outer peripheral surface of the distribution pipe.

8. The heat exchanger according to claim 7, wherein the collecting pipe has an outer peripheral surface, the first end of the first support is connected with the outer peripheral surface of the collecting pipe, the second end of the first support passes through the pipe wall of the collecting pipe, the first cavity and the baffle in sequence from the outer peripheral surface of the collecting pipe and extends into the second cavity, and the second end of the first support is in contact with the outer peripheral surface of the distribution pipe.

9. The heat exchanger according to claim 7, wherein the support assembly further comprises a second support, the second support extends into the second cavity from the second end of the collecting pipe, and the second support is adapted to support the outer peripheral surface of the distribution pipe.

10. The heat exchanger according to claim 1, wherein the collecting pipe is placed horizontally and has a length greater than 250 mm; the collecting pipe is a round pipe and a diameter of the collecting pipe is larger than a width of the heat exchange tube; the collecting pipe comprises a first end, a second end and an outer peripheral surface; a distance between the first end of the heat exchange tube and the second surface of the baffle is greater than 0 mm and less than or equal to 2 mm;

wherein the heat exchanger further comprises:

fins disposed between adjacent heat exchange tubes, the fins are at least partially connected to the heat exchange tubes;

a distribution pipe having a first end, a second end, a pipe wall, an inner space and an outer peripheral surface; the first end of the distribution pipe being a fluid inlet; the second end of the distribution pipe being closed and extending into the second cavity from the first end of the collecting pipe; a length of the distribution pipe extending into the second cavity being substantially the same as a length of the collecting pipe; the pipe wall of the distribution pipe defining a plurality of through holes disposed along a length direction of the distribution pipe; the through holes being in communication with the second cavity and the inner space of the distribution pipe; the through holes being opened at any position of the distribution pipe along a circumferential direction of the distribution pipe; and a support assembly comprising a plurality of first supports and a second support; the plurality of first supports being disposed along the length direction of the collecting pipe; each of the first supports comprising a first end and a second end; the first end of the first support being connected with the outer peripheral surface of the collecting pipe; the second end of the first support passing through the pipe wall of the collecting pipe, the first cavity and the baffle in sequence from the outer peripheral surface of the collecting pipe and extending into the second cavity; the second end of the first support being located below the distribution pipe and being in contact with the outer peripheral surface of the distribution pipe; the second support extending into the second cavity from the second end of the collecting pipe; the second support being located below the distribution pipe and being in contact with the outer peripheral surface of the distribution pipe.

11. The heat exchanger according to claim 1, wherein the collecting pipe is placed horizontally and has a length greater than 250 mm; the collecting pipe is a round pipe and a diameter of the collecting pipe is larger than a width of the heat exchange tube; the collecting pipe comprises a first end, a second end and an outer peripheral surface; a distance between the first end of the heat exchange tube and the second surface of the baffle adjacent to the second cavity is greater than 0 mm and less than or equal to 2 mm;

wherein the heat exchanger further comprises:

fins disposed between adjacent heat exchange tubes, the fins being at least partially connected to the heat exchange tubes;

a distribution pipe having a first end, a second end, a pipe wall, an inner space and an outer peripheral surface; the first end of the distribution pipe being a fluid inlet; the second end of the distribution pipe being closed and extending into the second cavity from the first end of the collecting pipe; a length of the distribution pipe extending into the second cavity being substantially the same as a length of the collecting pipe; the pipe wall of the distribution pipe defining a plurality of through holes disposed along a length direction of the distribution pipe; the through holes being in communication with the second cavity and the inner space of the distribution pipe; the through holes being opened at any position of the distribution pipe along a circumferential direction of the distribution pipe; and a support assembly comprising a plurality of first supports and a second support; the plurality of first supports being disposed along the length direction of the collecting pipe; each of the first supports comprising a first end and a second end; the first end of the first support being connected with the outer peripheral surface of the collecting pipe; the second end of the first support passing through the pipe wall of the collecting pipe, the first cavity and the baffle in sequence from the outer peripheral surface of the collecting pipe and extending into the second cavity; the first support being located below the distribution pipe and being in contact with the outer peripheral surface of the distribution pipe; the second support extending into the second cavity from the second end of the collecting pipe; the second support being located below the distribution pipe and being in contact with the outer peripheral surface of the distribution pipe.

12. The heat exchanger according to claim 1, wherein the plurality of flanges are integrally formed with the baffle.

13. The heat exchanger according to claim 1, wherein the corresponding slot comprises a narrower slot through which the first end of the heat exchange tube is inserted, and a wider slot in which the first end of the heat exchange tube resides; and wherein the wider slot is configured to communicate the inner channel of the heat exchange tube with the second cavity.

14. The heat exchanger according to claim 13, wherein the wider slot gradually widens along another direction from the first cavity toward the second cavity.

15. A heat exchanger, comprising:

a manifold extending along a transverse direction, the manifold comprising a wall and an inner cavity defined therein;

a partition disposed in the inner cavity along the transverse direction to divide the inner cavity into a first cavity and a second cavity being not in communication with each other; and a plurality of heat exchange tubes connecting with the manifold and spaced apart from each other along the transverse direction, each of the heat exchange tubes defining a row of micro-channels to communicate with the second cavity, each of the heat exchange tubes extending along a vertical direction perpendicular to the transverse direction;

a plurality of fins each disposed between adjacent heat exchange tubes, each heat exchange tube comprising a main body portion connecting with the fin and a first end portion extending from the main body portion to be inserted into the inner cavity;

a distribution pipe inserted into the second cavity, the distribution pipe defining a plurality of through holes arranged along the transverse direction, each of the through holes communicating with the second cavity;

wherein the partition defines a plurality of slots extending therethrough along the vertical direction; the partition comprises a bottom surface exposed to the first cavity and a top surface exposed to the second cavity;

the first end portion of each heat exchange tube is inserted into a corresponding slot, without protruding beyond the top surface of the partition, through the wall of the manifold and the first cavity in sequence, so that the micro-channel of each heat exchange tube is in communication with the second cavity via the corresponding slot.

16. The heat exchanger according to claim 15, wherein a length of the manifold is greater than 250 mm, and a distance between a top surface of the first end portion and the top surface of the partition is greater than 0 mm and less than or equal to 2 mm.

17. The heat exchanger according to claim 15, wherein the wall of the manifold defines a plurality of insertion holes disposed along the transverse direction, the slots and the insertion holes are disposed in a one-to-one correspondence manner along the vertical direction, and the first end portion of each heat exchange tube is inserted into a corresponding insertion hole, the first cavity and a corresponding slot in sequence.

18. The heat exchanger according to claim 15, wherein the partition comprises a plurality of flanges extending in a direction from the second cavity toward the first cavity and protruding beyond the first surface, each flange is surrounded around the corresponding slot, and each heat exchange tube is fastened to the flange.

19. The heat exchanger according to claim 15, wherein the corresponding slot comprises a narrower slot through which the first end portion of the heat exchange tube is inserted, and a wider slot in which the first end portion of the heat exchange tube resides; and wherein the wider slot is configured to communicate the micro-channel of the heat exchange tube with the second cavity.

20. The heat exchanger according to claim 19, wherein the wider slot gradually widens along a bottom-to-top direction.

* * * * *